US007971805B2

(12) United States Patent
Nolte et al.

(10) Patent No.: US 7,971,805 B2
(45) Date of Patent: Jul. 5, 2011

(54) ATOMIZER

(75) Inventors: Hans-Jürgen Nolte, Besigheim (DE); Frank Herre, Oberriexingen (DE); Andreas Fischer, Ludwigsburg (DE); Peter Marquardt, Steinheim (DE)

(73) Assignee: Durr Systems Inc., Auburn Hills, MI (US)

( * ) Notice: Subject to any disclaimer, the term of this patent is extended or adjusted under 35 U.S.C. 154(b) by 705 days.

(21) Appl. No.: 11/740,400

(22) Filed: Apr. 26, 2007

(65) Prior Publication Data

US 2007/0262170 A1 Nov. 15, 2007

(30) Foreign Application Priority Data

Apr. 28, 2006 (DE) ..... 10 2006 019 890

(51) Int. Cl.
*B05B 1/28* (2006.01)

(52) U.S. Cl. ..... 239/290; 239/128; 239/135; 239/293; 239/296; 239/300

(58) Field of Classification Search ..... 239/290, 239/291, 293, 296, 297, 300, 301, DIG. 14, 239/128, 135; 427/427.2, 427.3
See application file for complete search history.

(56) References Cited

U.S. PATENT DOCUMENTS

| | | | | |
|---|---|---|---|---|
| 3,857,511 | A | 12/1974 | Govindan | |
| 4,936,510 | A * | 6/1990 | Weinstein | 239/223 |
| 5,980,994 | A * | 11/1999 | Honma et al. | 427/475 |
| 6,050,499 | A * | 4/2000 | Takayama et al. | 239/112 |
| 6,534,127 | B2 * | 3/2003 | Ohmoto et al. | 427/407.1 |
| 6,889,921 | B2 * | 5/2005 | Schaupp | 239/700 |
| 2004/0081769 | A1 * | 4/2004 | Krumma et al. | 427/421 |
| 2004/0129799 | A1 * | 7/2004 | Krumma et al. | 239/290 |
| 2004/0163588 | A1 | 8/2004 | Arvin et al. | |
| 2005/0181142 | A1 | 8/2005 | Hirano et al. | |

FOREIGN PATENT DOCUMENTS

| | | | |
|---|---|---|---|
| DE | 19749072 | C1 | 6/1999 |
| DE | 10232863 | A1 | 2/2004 |
| EP | 1362640 | A1 | 11/2003 |
| JP | 58092475 | A | 6/1983 |
| JP | 8084941 | A | 4/1996 |
| WO | WO-2005110618 | A1 | 11/2005 |

OTHER PUBLICATIONS

European Search Report EP 07 00 7204, Dated Mar. 26, 2010.

* cited by examiner

*Primary Examiner* — Jason J Boeckmann
(74) *Attorney, Agent, or Firm* — Rader Fishman & Grauer

(57) ABSTRACT

The invention relates to an atomizer and method of operation for an atomizer having an application element for applying a spray of coating medium on a component to be coated and at least one integrated shroud air nozzle for delivering conditioned shroud air which at least partially surrounds the spray of the coating medium.

24 Claims, 3 Drawing Sheets

ATOMIZER

FIELD OF THE INVENTION

CROSS-REFERENCE TO RELATED APPLICATIONS

This application claims priority to German Patent Application No. DE 10 2006 019 890.5, filed Apr. 28, 2006, the complete disclosure of which is hereby incorporated herein by reference in its entirety.

The invention generally relates to an atomizer for coating mediums and an associated operating method.

Background

In the painting of components (e.g., motor vehicle body parts), the particular coating medium (e.g., filler, basecoat, clearcoat) is usually atomized by high-speed rotary atomizers and applied to the part to be coated by means of shaping air and electrostatic charging of the coating medium. When painting with liquid paint, the wet paint, when atomized and during atomization, loses primarily volatile components, such as for example solvents which flash off into the ambient air. As a result, the percentage of solids in the applied liquid paint changes compared with the percentage of solids in the liquid paint before atomization.

Firstly, this increase in the amount of solids during application is determined by the application parameters, such as for example the speed of the rotary atomizer, discharge volume, shaping air volume and distance.

Secondly, the increase in the amount of solids during application is affected by ambient conditions, such as for example humidity, air velocity and air temperature in the paint booth since these ambient conditions affect the evaporation of the solvent constituent.

In the case of the known painting installations for painting motor vehicle body parts, great expense is incurred in keeping the air management in the paint booth constant so that evaporative conditions, and thus the increase in solids during application, remain constant. Thus the disadvantage of the known paint installations is the great expense for equipment for conditioning the air in the paint booth.

It is known from US2005/0181142A1 to surround the spray of coating medium from a rotary atomizer with a flow of conditioned shroud air where the shroud air produces specific ambient conditions on the outside of the spray of coating medium so that the expense for conditioning the entire paint booth can be reduced. The shroud air is delivered by a separate adapter which has an annular configuration and is disposed on the outside on the atomizer housing during operation. This known type of shroud air generation, however, reveals numerous disadvantages.

First, the additional adapter disrupts the otherwise smooth outer contour of the rotary atomizer, which increases the tendency for contamination and cleaning the rotary atomizer is made more difficult.

Second, the supply of conditioned air has to be brought to the adapter through additional hoses which are stressed by material fatigue from the frequent and rapid movements of the painting robots.

Moreover, the additional adapter hinders the manipulation of the rotary atomizer since the outer dimensions and the mass inertia of the rotary atomizer increase as a result of the additional adapter. For example, the rotary atomizer with the additional adapter cannot be introduced into small openings to coat surfaces located there because of the larger outside dimensions.

A further disadvantage of the additional adapter consists in the relatively large axial distance between the shroud air nozzles in the adapter and the atomizing edge of the bell cup so that energy and volume of the shroud air are normally not adequate to achieve specified flash-off conditions properly.

SUMMARY OF THE INVENTION

The invention embraces the general technical teaching that the flash-off conditions and thus, the change in the proportion of solids, can be affected during application in the environment of the spray of coating medium by creating a specific microclimate so that expensive air conditioning of the entire spray booth is less important or can even be omitted.

In a preferred aspect of the invention, the shroud air is, in contrast to the previously discussed prior art, not delivered through a separate adapter but through at least one shroud air nozzle which is structurally integrated into the atomizer. This structural integration of the shroud air nozzles into the atomizer offers the advantage that the smooth outer contour of the atomizer housing is not disturbed by the shroud air equipment so the potential for contamination is reduced and the ease of cleaning of the atomizer is not compromised.

In addition, the structural integration of the shroud air nozzles into the atomizer makes it possible for the conditioned air for the shroud air to be supplied through the normal connecting flange of the atomizer. The separate hoses provided in the prior designs for supplying the conditioned air can be dispensed with, which eliminates the problem of fatigued hoses.

In addition, the invention advantageously makes it possible to reduce the axial distance between the shroud air nozzles and the spraying edge of the bell cup so that energy and volume of the shroud air are sufficient to produce properly defined flash-off conditions.

An additional advantage of the integration of the shroud air nozzles into the atomizer, consists in better handling since the outer dimensions and the mass inertia of the atomizer in accordance with the invention, as compared with a conventional atomizer without shroud air equipment, are increased only a small amount or not increased at all.

In preferred aspect, the structural integration of the shroud air nozzles into the atomizer can be achieved, for example, by having the shroud air nozzles disposed in the atomizer housing. In an alternate aspect, the shroud air nozzles may be located in a shaping air ring nozzles or another integral component of the atomizer.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
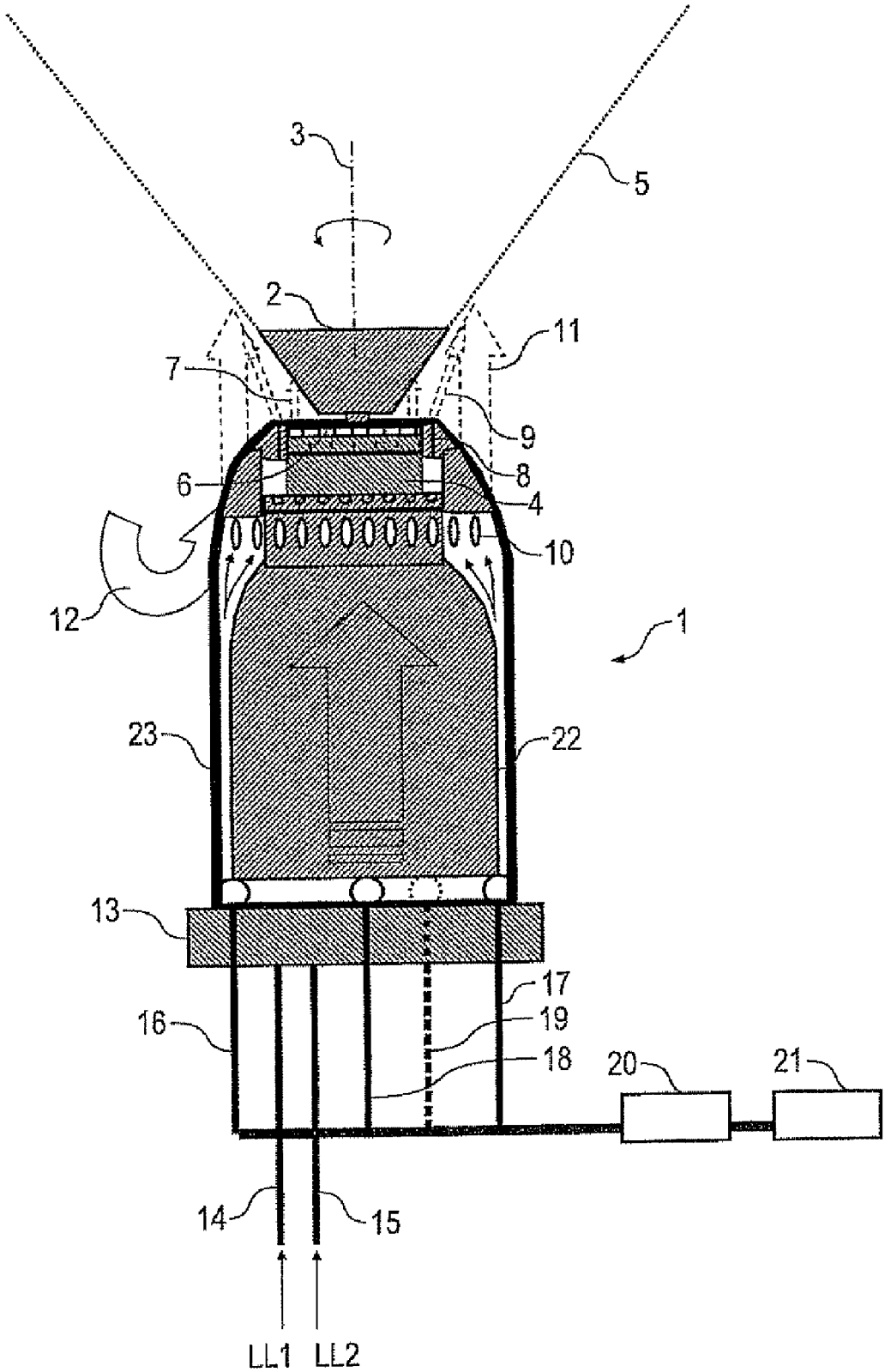
FIG. 1 shows a schematic view of one example of a rotary atomizer in accordance with the invention with numerous shroud air nozzles.

FIG. 1 shows in a simplified form a rotary atomizer 1 which is, in part, conventional in construction and can be used, for example, for painting motor vehicle body parts. As an application element, the rotary atomizer 1 has a conventional bell cup 2 which is rotatably carried around a bell cup axis 3 and driven by a turbine 4. The bell cup 2 dispenses a spray of coating medium 5 at the bell cup edge, where the spray of coating medium 5 is shown only schematically for ease of illustration.

The rotary atomizer 1 has numerous internal shaping air nozzles 6 which are disposed concentrically around the bell cup axis 3 and dispense an internal shaping air stream 7 onto the outer lateral surface of the bell cup 2 where the internal shaping air stream 7 forms the spray of coating medium 5.

In addition, the rotary atomizer 1 has several external shaping air nozzles 8 through which an external shaping air stream 9 is dispensed which additionally forms the spray of coating medium 5. It is understood less or more streams of shaping air, from alternately configured internal and external shaping nozzles, may be used without deviating from the present invention.

The rotary atomizer 1 of the present invention, in addition to an application element (e.g. a bell cup 2) for applying a spray of coating medium 5 to a part to be coated, has at least one shroud air nozzle 10 through which conditioned shroud air 11 is dispensed which at least partially surrounds the spray of coating medium 5 and thereby generates a specific microclimate in the environment of the spray of coating medium 5 which provides specific flash-off conditions. Preferably, the conditioned shroud air 11 surrounds the spray of coating material 5 like a sheath over its entire periphery and/or over its entire length between the application element 2 and the part to be coated.

In a preferred aspect, the rotary atomizer 1 has numerous shroud air nozzles 10 which are separate from the exterior shaping air nozzles 8 and also located concentrically about the bell cup axis 3 and dispense conditioned shroud air 11 which encloses the spray of coating medium 5 in the manner of a sheath and thereby provides controlled and defined flash-off conditions. In an alternate aspect, it is understood that the external shaping nozzles 8, or other shaping air nozzles, may serve as the shroud air nozzles 10.

When the shroud air 11 leaves the shroud air nozzles 10, it entrains a subsidiary stream 12 of ambient air where the entrained subsidiary stream 12 constitutes 0-50% of the shroud air 11 exiting the shroud air nozzles 10.

The supply of shroud air 11, the coating medium 5 and the shaping air is managed through a connecting flange 13 to which two separate shaping air lines 14, 15 can be attached. Moreover, shroud air lines 16, 17, 18 and an optional shroud air line 19 can be attached to the connecting flange 13 to supply the conditioned shroud air 11 to the rotary atomizer 1. The shroud air lines 16-19 are preferably connected to an air heater 20 and a mass air volumetric flow regulator 21.

As part of the conditioning or manipulating of the shroud air 11, shroud air 11 may be, as compared with the ambient air in the immediate environment of atomizer 1, heated, cooled, dried, humidified and/or otherwise altered from ambient. Heating of the shroud air 11 is achieved preferably by the heater 20 which is preferably structurally separated from the atomizer. Alternately, heating of the shroud air 11 may be accomplished through heating hoses or electric heating elements (not shown) where the heating elements can be located close to the outlet in the area of the shroud air nozzle 10, which results in low thermal losses. In the case of an electrostatic atomizer, the heating of the shroud air, however, for reasons of explosion protection, is preferably not undertaken by electric heating elements in the atomizer but by the aforementioned separate air heater 20.

Preferably, the shroud air 11 has an outlet temperature immediately at the shroud air nozzle 10 of more than +30° C. and less than +200° C., where any intermediate values within this range of values are possible. Other temperatures known by those skilled in the art may be used. The outlet temperature of the shroud air 11 can be varied as a function of the coating medium 5 employed. For example, water as a solvent evaporates less than organic solvents so that the outlet temperature of the shroud air can be raised during application of water-borne paint compared with the application of solvent-based paint.

Preferably, the shroud air 11 has a volumetric flow of more than 250 liters per minute (l/min) and less than 2500 l/min, where any intermediate values within this interval are possible. Other values known by those skilled in the art may be used.

The shroud air 11 preferably consists of air which is available in any case in painting installations in the form of compressed air. It is understood that a different gas other than air for the shroud air 11 may be used. For example, special gases are available which have a greater heat capacity, a greater electrical insulating capability and/or a higher saturation limit than air. The greater heat capacity offers the advantage that, after leaving the shroud air nozzle 10, the shroud air 11 looses only a little temperature, which provides defined flash-off conditions. A greater electrical insulation capability is, on the other hand, advantageous in the case of an electrostatic atomizer since the insulating capability of the shroud air 11 prevents a discharge of the electrostatically charged coating medium particles and thereby provides high transfer efficiency. A high saturation limit of the gas employed for the shroud air 11 is advantageous if the shroud air 11 is to absorb much solvent from the spray of coating medium. The shroud air 11 can also consist of, for example, sulfur hexafluoride ($SF_6$) or inert gases (for example carbon dioxide ($CO_2$) and nitrogen). Other altered air or other gases known by those skilled in the art may be used.

In a preferred aspect, the supply of shroud air 11 from the connecting flange 13 to the shroud air nozzles 10 is made by a shroud air passage between an inner housing 22 and an outer housing 23 of the rotary atomizer 1. This offers the advantage that the shroud air 11 is cooled only relatively little when conducted or passed through through the atomizer and therefore, still retains sufficient temperature at the shroud air nozzle 10.

In an alternate aspect, the shroud air 11 may be provided by the shaping air supply so that the connecting flange 13 of the atomizer with the flanged connections provided there does not have to be modified.

In a preferred embodiment, the number of shroud air nozzles 10 can be in the range of 5 to 100, and the individual shroud air nozzles 10 have nozzle openings with a width of 1-15 mm in diameter. It is preferred that the opening width of the shroud nozzles 10 are greater than the opening widths of the shaping nozzles.

The application element is preferably a rotatable bell cup 2 which has a defined bell cup edge. Preferably, an axial distance of more than 2 millimeters (mm) and less than 150 mm is between the shroud air nozzle 10 and the edge of the bell cup. It is understood that other numbers of shroud air nozzles 10, widths of shroud air nozzle openings and axial distances between the bell cup and shroud nozzles 10 known by those skilled in the art may be used.

Furthermore, the shroud air nozzles 10 can be angled in the circumferential direction of the bell cup 2 and thus have a specified swirl angle where the shroud air nozzles 10 can be angled either in the rotational direction of the bell or against the rotational direction of the bell. The swirl angle of the shroud air nozzles 10 can be in the range of 0-45° where any intermediate values are possible.

Figure 2A:
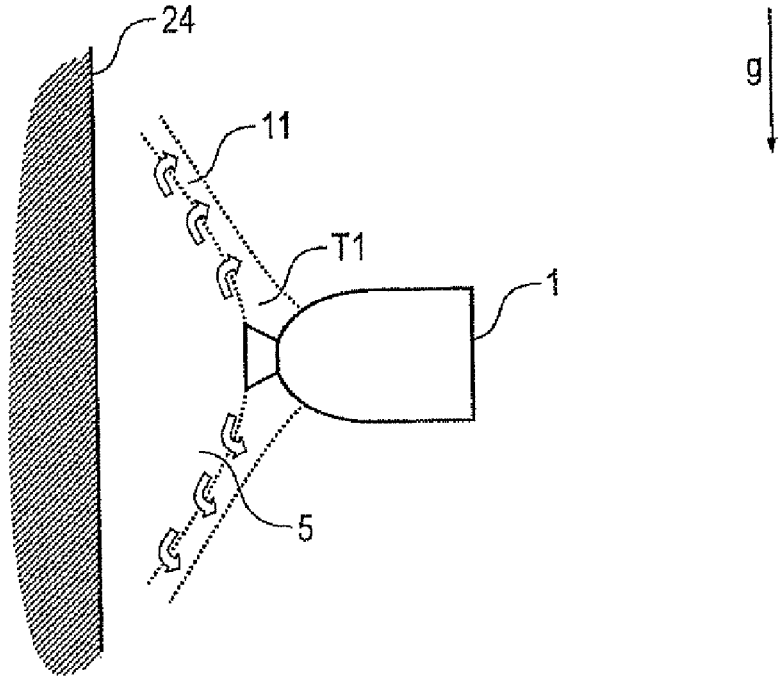
FIGS. 2*a* and 2*b* are schematic views illustrating exemplary variations in the shroud air when painting vertical and horizontal components.

FIG. 2*a* schematically shows the exemplary painting of a vertical component surface 24 by the rotary atomizer 1. Because of the vertical orientation of the component surface 24, the danger of coating or paint runs exists because of gravity (shown in the direction g) acting on the paint particles applied. To prevent such runs, the percentage of solids in the spray of coating medium 5 hitting the vertical component surface 24 is selectively increased in which the temperature T1 of the shroud air 11 is increased selectively by the air heater 20 (refer to FIG. 1). As a result, the spray of coating medium 5 hitting the vertical component surface 24 contains smaller amounts of liquid solvent and therefore, tends to run less. The evaporation of the solvent from the spray coating medium 5 in the surrounding shroud air 11 is schematically illustrated by block arrows for ease of illustration.

Figure 2B:
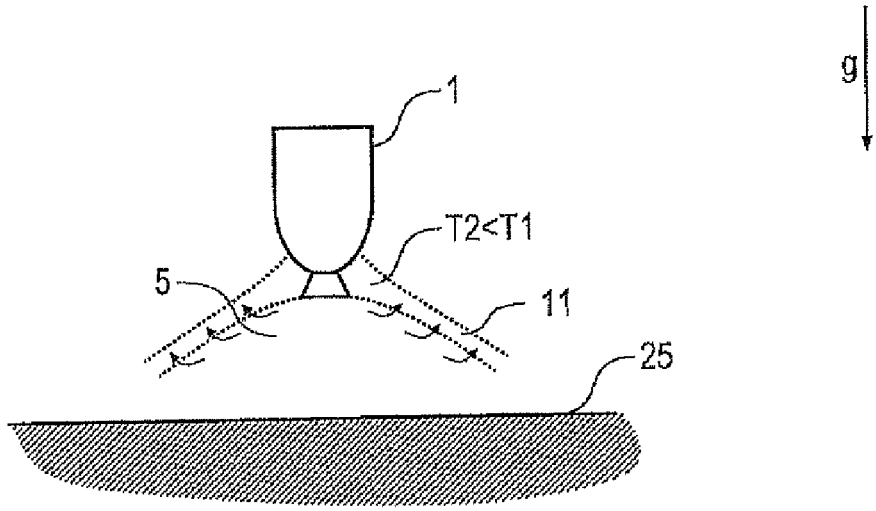

FIG. 2*b*, in contrast, shows the exemplary painting of a horizontal component surface 25 by the rotary atomizer 1. Because of the horizontal orientation of the component surface 25, the danger of coating or paint runs in the coating medium 5 on the component surface 25 is less, so that smaller amounts of liquid solvent have to evaporate into the shroud air 11. The shroud air 11 therefore, may have a lower temperature T2<T1 when the horizontal component surface 25 is being painted than when the vertical component surface 24 is being painted.

Figure 3:
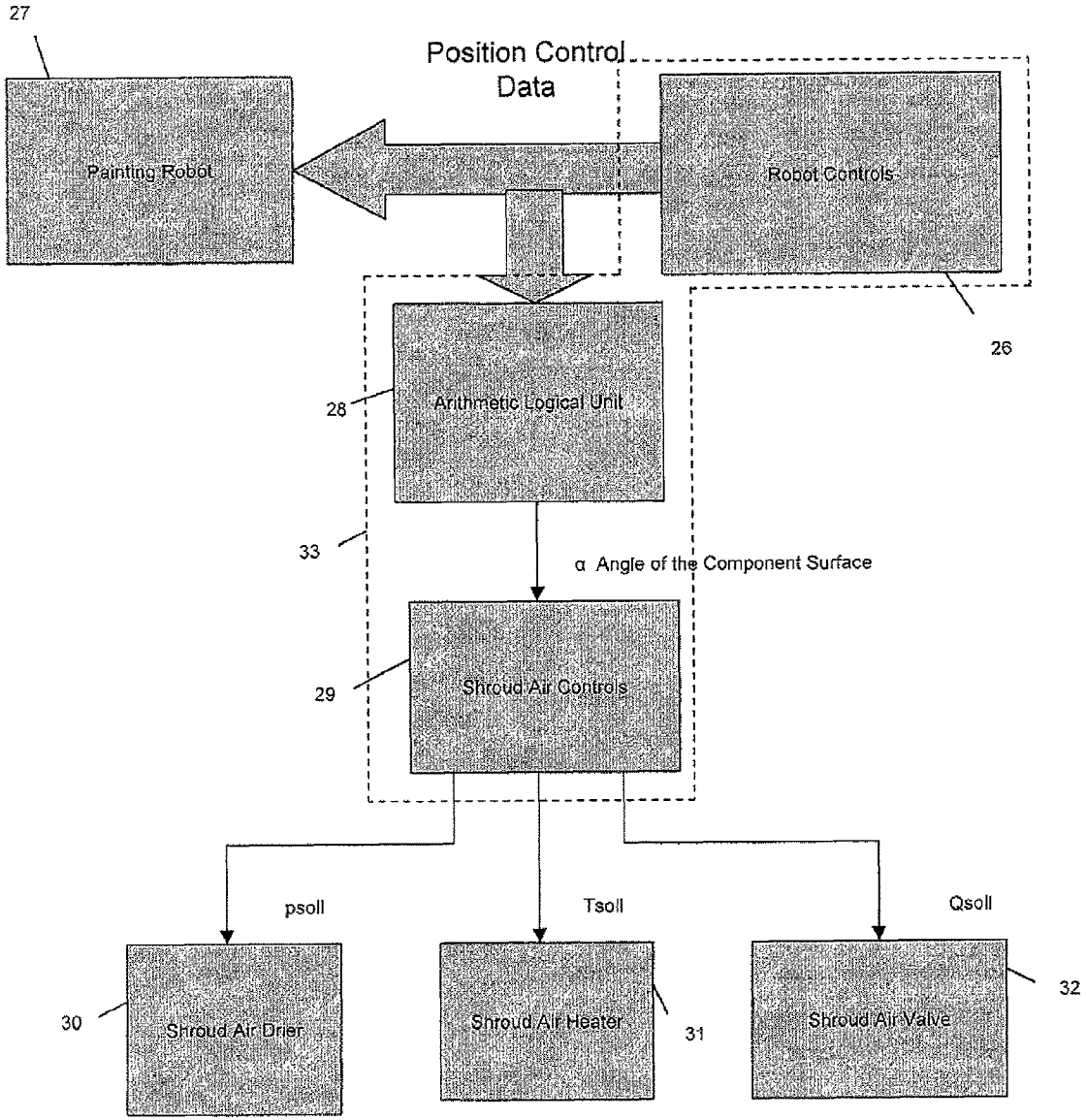
FIG. 3 shows a highly simplified schematic and exemplary block diagram of a painting apparatus in accordance with the invention.

Referring to FIGS. 1 and 3, a painting apparatus including atomizer 1 is shown. FIG. 3 shows in highly simplified and exemplary block diagram form, a painting apparatus in accordance with the invention. The example includes an atomizer 1 (not shown) connected to a painting robot 27. Painting robot 27 is electronically connected to a robot control system 26 which activates multi-axis painting robot 27 using positioning control data, for example positional data of the atomizer 1 or robot 27, wherein the painting robot 27 guides the rotary atomizer 1 (not shown in FIG. 3).

The positioning control data is relayed by the robot control system 26 to an arithmetic logical unit 28 which determines therefrom the angle $\alpha$ of the component surface to be coated, for example whether the component surface is substantially horizontal or vertical. The angle $\alpha$ of the component surface is then relayed to a shroud air control 29 which influences, conditions and/or manipulates the shroud air 1, for example, as a function of the angle $\alpha$ of the component surface. The shroud air control 29 than selectively activates a shroud air drier 30, a shroud air heater 31 and/or a shroud air valve 32. In this example, the shroud air 11 is this influenced or conditioned as a function of the angle $\alpha$ of the component surface to be coated such that a run in the coating medium 5 on the component surface is prevented. To do thus, the shroud air is, for example, heated and dried more when coating vertically oriented component surfaces than when coating horizontally oriented component surfaces. Other methods of conditioning shroud air 11, determining the orientation of the component surface to be coated and controlling robot 27 known by those skilled in the art may be used.

It is further contemplated the robot control 26, the arithmetic logical unit 28 and the shroud air controls 29 can be integrated into a common electronic control unit 33. The possibility also exists that the robot controls 26, the arithmetic logical unit 28 and/or the shroud air controls 29 are implemented as software modules. Other combinations of control units or logic functions known by those skilled in the art may be used.

The inventive atomizer further, for example, includes an operating method wherein air 11 is dispensed which at least partially surrounds the spray of coating medium 5. Through manipulating of the shroud air 11 as a function of the spatial location or orientation of the surface of the part to be coated, the paint or coating applied when painting the surfaces of vertical parts can flow out more easily than during the painting of the surfaces of horizontal part so that the percentage of solids should be increased when painting vertical surfaces compared with the painting of horizontal surfaces.

The spatial location of the component surface to be coated is preferably determined and the shroud air 11 is manipulated as a function of the spatial location determined. Instead of the spatial location of the component surface to be coated, the spatial location of the atomizer can be determined since the atomizer is usually guided in accordance with the spatial location of the component surface to be coated. When using a multi-axis painting robot 27, the spatial location of the atomizer 1 can be determined in turn from the position-control signals from the robot controls.

Depending on the spatial location of the component surface to be coated and/or of the atomizer, the temperature, the humidity content and/or the volumetric flow of the shroud air 11 can be manipulated to achieve the desired characteristics of coating materials sprays.

Preferably, when coating a substantially vertical component surface, for example in FIG. 2A, shroud air 11 with a lower humidity content, a higher temperature and/or a higher volumetric flow is dispensed than when coating a substantially horizontal component surface, for example in FIG. 2B. The shroud air 11 is not constant, but is affected as a function of a process parameter which affects the coating process. In the case of the process parameter of interest, it can be, for example, the aforementioned spatial location of the component surface to be coated, or the atomizer.

It is further understood that a process parameter of interest which may affect the shroud air 11 is the type of part to be coated. For example, when painting high-quality vehicle bodies or components, a different shroud air 11 can be dispensed than when painting lesser quality vehicle bodies.

In addition, the relevant process parameter which may affect the shroud air 11, is the coating medium used, for example, the percentage of solids or the percentage of solvents present in the coating medium or paint 5. The shroud air 11 can be adjusted in such a way that the percentage of solid bodies in the spray of coating medium 5 from a time between being dispensed at the application element and at impact on the component surface to be coated, increases by more than 5%, 10%, 25% or even 50%.

The invention is not limited to such painting installations in which conventional conditioning of the air is dispensed with, but also includes painting installations in which, in addition to the creation of a defined microclimate in the environment of the spray of coating medium, conditioning of the air in the entire spray booth is undertaken. The atomizer in accordance with the invention can optionally be a powder atomizer or a liquid paint atomizer.

While the invention has been described in connection with what is presently considered to be the most practical and preferred embodiment, it is to be understood that the invention is not to be limited t the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An atomizer for use in dispensing a spray of coating medium onto a component surface, the atomizer comprising;

an application element positioned along a rotational axis for dispensing a spray of the coating medium in a direction away from the application element;

a housing positioned adjacent the application element along the axis, the housing configured to enclose an atomizer motor configured to rotate the application element when the application element dispenses the spray;

a shroud air nozzle integral with the housing positioned radially outward from the rotational axis, the shroud air nozzle adapted to dispense conditioned shroud air which at least partially surrounds the coating medium spray;

a shroud air conditioner configured to condition shroud air upstream of the housing, wherein the conditioner includes at least one of a heater, a cooler, a humidifier, and a dehumidifier, and the conditioned air is at least one of heated, cooled, humidified, and dehumidified, respectively, with respect to the ambient air around the atomizer; and a control system in communication with the shroud air conditioner and configured to selectively activate the at least one of the heater, the cooler, the humidifier, and the dehumidifier, according to an operating condition associated with the application element when the application element is dispensing the spray wherein the control system is configured to detect the orientation angle if the component surface, wherein the control system is configured to condition the shroud air such that the shroud air includes at least one of a lower humidity content and a higher temperature when the component surface is substantially vertical compared with when the component surface is substantially horizontal.

2. The atomizer of claim 1 wherein the housing further comprises:

an inner housing; and an outer housing positioned radially and concentrically outward from the inner housing defining a shroud air passageway between the inner and the outer housings in communication with the shroud air nozzle.

3. The atomizer of claim 1 further comprising:

a plurality of at least one of internal shaping air nozzles and external shaping air nozzles positioned radially outward from the axis and adapted to dispense a shaping air stream to form the coating medium spray.

4. The atomizer of claim 3 wherein the shroud air nozzle is positioned radially outward of the external shaping nozzles from the axis.

5. The atomizer of claim 1, further comprising:

a plurality of internal shaping air nozzles positioned radially outward from the axis and adapted to dispense a shaping air stream to form the coating medium spray; and a plurality of external shaping air nozzles positioned radially outward from the internal shaping air nozzles, the plurality of external shaping air nozzles including the shroud air nozzle.

6. The atomizer of claim 1 wherein the application element is a bell cup rotatable about the axis and having a bell cup edge.

7. The atomizer of claim 6 wherein the axial separation between the shroud air nozzle and the bell cup edge is between approximately 2 and 150 millimeters.

8. The atomizer of claim 6 wherein the at least one shroud air nozzle is positioned in an angled orientation in the circumferential direction about the axis and has a predetermined spin angle.

9. The atomizer of claim 8 wherein the predetermined spin angle of the shroud air nozzle is between approximately 0 degrees and 45 degrees.

10. The atomizer of claim 6 wherein the at least one shroud air nozzles are angled in either the rotational direction of the bell cup or in a direction away from the rotational direction of the bell cup.

11. The atomizer of claim 1 wherein the width of the shroud air nozzle is between approximately 1 and 15 millimeters in diameter.

12. The atomizer of claim 1 wherein the at least one shroud air nozzle comprises between approximately 5 and 100 nozzles.

13. The atomizer of claim 1 wherein the conditioned shroud air comprises at least one of: air, a gas other than air having a higher heating capacity than air, a gas other than air having a higher electrical insulating capability than air, and a gas other than air with a higher saturation limit than air.

14. The atomizer of claim 1 wherein the shroud air exiting the shroud air nozzle is between approximately 30 and 200 degrees Celcius.

15. The atomizer of claim 14 wherein the shroud air has a volumetric flow of between approximately 250 and 2500 liters per minute.

16. The atomizer of claim 1 further comprising a connecting flange for use in connecting the atomizer to a robot, the connecting flange having at least one receptacle for connection of a shroud air supply through the flange.

17. The atomizer of claim 1 further comprising a shroud air duct positioned at least partially inside the housing for supplying shroud air to the shroud air nozzle.

18. The atomizer of claim 1 wherein the housing has a smooth outer contour.

19. The atomizer of claim 1 further comprising a painting apparatus having a robot for holding and positioning the atomizer, at least one of a shroud air drier and a shroud air heater, and a controller for controlling the painting apparatus.

20. The atomizer of claim 1, wherein the operating condition is an operating angle of the application element, the operating angle of the application element associated with an angle of the component surface relative to the force of gravity.

21. The atomizer of claim 1, wherein the shroud air conditioner is structurally separate from the housing.

22. The atomizer of claim 1 wherein the application element is rotatable about the axis.

23. A rotary atomizer for use in dispensing a spray of coating medium onto a component surface, the rotary atomizer comprising:

a rotary bell cup positioned along a rotational axis and having an edge for dispensing a spray of the coating medium in a direction away from the bell cup;

a housing axially positioned from the bell cup along the axis, the housing having an inner housing and a smooth outer contoured outer housing positioned concentrically and radially outward from the inner housing from the axis defining a shroud air passageway, the housing configured to enclose an atomizer motor configured to rotate the rotary bell cup when the rotary bell cup dispenses the spray;

a plurality of at least one of internal shaping air nozzles and external shaping air nozzles positioned in the housing adjacent the bell cup adapted to dispense shaping air to form the coating medium spray;

a plurality of shroud air nozzles integral with the housing positioned radially outward from the axis, the shroud air nozzles adapted to dispense conditioned shroud air which at least partially surrounds the coating medium spray;

a connecting flange for connecting the atomizer to a robotic device, the connecting flange having a plurality of connections through which the shaping air, the shroud air and the coating medium is supplied therethrough;

a shroud air conditioner configured to condition shroud air upstream of the housing, wherein the conditioner includes at least one of a heater, a cooler, a humidifier, and a dehumidifier, and the conditioned air is at least one of heated, cooled, humidified, and dehumidified, respectively, with respect to the ambient air around the atomizer; and a control system in communication with the shroud air conditioner and configured to selectively activate the at least one of the heater, the cooler, the humidifier, and the dehumidifier, according to an operating condition associated with the application element when the application element is dispensing the spray wherein the control system is configured to detect the orientation angle if the component surface, wherein the control system is configured to condition the shroud air such that the shroud air includes at least one of a lower humidity content and a higher temperature when the component surface is substantially vertical compared with when the component surface is substantially horizontal.

24. The rotary atomizer of claim 23 further comprising:

a controller for determining coating medium process parameters that affect the coating process and determining the conditioning of the shroud air based on the process parameters.

* * * * *

UNITED STATES PATENT AND TRADEMARK OFFICE

CERTIFICATE OF CORRECTION

PATENT NO. : 7,971,805 B2
APPLICATION NO. : 11/740400
DATED : July 5, 2011
INVENTOR(S) : Hans-Jurgen Nolte et al.

It is certified that error appears in the above-identified patent and that said Letters Patent is hereby corrected as shown below:

At column 7, claim number 1, line number 31, change “if” to -- of --

At column 10, claim number 23, line number 5, change “if” to -- of --

Signed and Sealed this
Twenty-seventh Day of September, 2011

David J. Kappos

David J. Kappos
*Director of the United States Patent and Trademark Office*